US009362699B2

(12) United States Patent
Stull

(10) Patent No.: US 9,362,699 B2
(45) Date of Patent: Jun. 7, 2016

(54) ULTRASONIC TRANSDUCERS FOR TERMINAL CRIMPING DEVICES

(71) Applicant: Tyco Electronics Corporation, Berwyn, PA (US)

(72) Inventor: David Michael Stull, Etters, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 138 days.

(21) Appl. No.: 14/032,667

(22) Filed: Sep. 20, 2013

(65) Prior Publication Data

US 2015/0082622 A1 Mar. 26, 2015

(51) Int. Cl.

| | |
|---|---|
| ***H01R 43/058*** | (2006.01) |
| ***H01R 43/048*** | (2006.01) |
| ***H01R 43/02*** | (2006.01) |
| *H01R 4/18* | (2006.01) |

(52) U.S. Cl.

CPC ..... *H01R 43/048* (2013.01); *H01R 43/0207* (2013.01); *H01R 43/058* (2013.01); *H01R 4/183* (2013.01); *Y10T 29/53235* (2015.01)

(58) Field of Classification Search

CPC ..... G01N 29/00; H01R 43/0421; H01R 43/0207; H01R 43/048; H01R 43/058; H01R 4/183

USPC ..... 29/753–758, 863, 705, 720; 73/600, 73/602; 72/7.2, 16.2, 31.1

See application file for complete search history.

(56) References Cited

U.S. PATENT DOCUMENTS

| | | | | |
|---|---|---|---|---|
| 5,046,241 | A * | 9/1991 | Ricard | 29/863 |
| 5,297,435 | A * | 3/1994 | Papazian | 73/597 |
| 5,937,505 | A * | 8/1999 | Strong et al. | 29/593 |
| 7,181,942 | B2 | 2/2007 | Yost et al. | |
| 8,490,463 | B2 * | 7/2013 | Yost et al. | 73/1.82 |
| 8,671,551 | B2 * | 3/2014 | Yost et al. | 29/593 |
| 9,003,645 | B1 * | 4/2015 | Yost et al. | 29/753 |
| 2012/0192407 | A1 | 8/2012 | Yost et al. | |
| 2015/0047182 | A1 * | 2/2015 | Charlton | H01R 43/0488 29/753 |
| 2015/0047189 | A1 * | 2/2015 | Stull | H01R 43/0486 29/863 |

FOREIGN PATENT DOCUMENTS

| | | |
|---|---|---|
| GB | 2 340 674 A | 2/2000 |
| JP | 2005 135803 A | 5/2005 |

OTHER PUBLICATIONS

International Search Report, International Application No. PCT/US2014/054464, International Filing Date, Sep. 8, 2014.

* cited by examiner

*Primary Examiner* — Minh Trinh

(57) ABSTRACT

A terminal crimping device includes crimp tooling including an anvil and a ram movable toward the anvil. A crimp zone is defined between the anvil and the ram that receives a wire and a terminal configured to be crimped to the wire by the crimp tooling. An ultrasonic transducer assembly is held by at least one of the anvil and the ram. The ultrasonic transducer assembly is ultrasonically coupled to the terminal and is ultrasonically isolated from the crimp tooling. The ultrasonic transducer assembly may directly engage the terminal. The terminal crimping device may include an isolation member ultrasonically isolating the ultrasonic transducer assembly from the crimp tooling.

20 Claims, 4 Drawing Sheets

ULTRASONIC TRANSDUCERS FOR TERMINAL CRIMPING DEVICES

BACKGROUND OF THE INVENTION

The subject matter herein relates generally to terminal crimping devices using ultrasonic transducers.

Terminals are typically crimped onto wires by means of a conventional crimping press having an anvil for supporting the electrical terminal and a ram that is movable toward and away from the anvil for crimping the terminal. In operation, a terminal is placed on the anvil, an end of a wire is inserted into the ferrule or barrel of the terminal, and the ram is caused to move toward the anvil to the limit of the stroke of the press, thereby crimping the terminal onto the wire. The ram is then retracted to its starting point.

New technologies in ultrasonic monitoring have been proposed for use in crimp quality monitoring. For example, U.S. Pat. No. 7,181,942 describes an ultrasonic device and method for measuring crimp connections by comparing signals with signals from a previous crimp that was determined to be desirable through destructive testing.

Such ultrasonic monitoring systems are not without disadvantages. For instance, the ultrasonic acoustic signals are passed through the ram and anvil and across the boundaries of such crimp tooling with the terminal. Due to the complex shape of the crimp tooling required to deform the electrical terminal during the crimping process, the ultrasonic acoustic signals are reflected and echo off of the surfaces in many directions causing noise in the received signal. The signal reflections decrease the signal-to-noise ratio of the received signal and reduce the effectiveness of the analysis methods to detect crimp anomalies. Reduction in signal quality reduces the ability to detect quality errors which the ultrasonic monitoring system is designed to detect.

A need remains for a crimp quality monitoring system having improved signal reception at the receiving transducer.

BRIEF DESCRIPTION OF THE INVENTION

In an embodiment, a terminal crimping device is provided that includes crimp tooling including an anvil and a ram movable toward the anvil. A crimp zone is defined between the anvil and the ram that receives a wire and a terminal configured to be crimped to the wire by the crimp tooling. An ultrasonic transducer assembly is held by at least one of the anvil and the ram. The ultrasonic transducer assembly is ultrasonically coupled to the terminal and is ultrasonically isolated from the crimp tooling. The ultrasonic transducer assembly may directly engage the terminal. The terminal crimping device may include an isolation member ultrasonically isolating the ultrasonic transducer assembly from the crimp tooling.

Optionally, the crimp tooling may include a recess. The recess may be lined with an isolation member. The ultrasonic transducer assembly may be received in the recess to engage the terminal. The isolation member may be positioned between the ultrasonic transducer assembly and the crimp tooling to ultrasonically isolate the ultrasonic transducer assembly from the crimp tooling. The crimp tooling may include a crimping surface configured to engage the terminal during the crimping process. The crimp tooling may have a recess open at the crimping surface and the ultrasonic transducer assembly may be received in the recess and engage the terminal.

Optionally, the ultrasonic transducer assembly may include a transmitting transducer configured to transmit acoustic signals and a transmitting probe extending from the transmitting transducer. The transmitting probe may directly engage the terminal to transmit the acoustic signals from the transmitting probe to the terminal. The transmitting probe may extend between a first end and a second end. The first end may directly engage and be ultrasonically coupled to the transmitting transducer. The second end may directly engage and being ultrasonically coupled to the terminal.

Optionally, the ultrasonic transducer assembly may be spring biased against the terminal to ensure direct physical contact between the ultrasonic transducer assembly and the terminal sufficient to allow ultrasonic acoustic signals to pass through the interface between the ultrasonic transducer assembly and the terminal. The terminal crimping device may include a compression member operatively coupled to the ultrasonic transducer assembly that forces the ultrasonic transducer assembly into engagement with the terminal.

Optionally, the crimp tooling may include a recess having an opening at the terminal. The ultrasonic transducer assembly may be received in the recess. The recess may receive a protrusion of the terminal formed during the crimping process. The ultrasonic transducer assembly may engage the protrusion within the recess. The terminal crimping device may include a controller operatively coupled to the ultrasonic transducer assembly. The controller may cause the ultrasonic transducer assembly to transmit ultrasonic acoustic signals only after the protrusion contacts the ultrasonic transducer assembly.

In another embodiment, a terminal crimping device is provided that includes crimp tooling including an anvil and a ram movable toward the anvil. A crimp zone is defined between the anvil and the ram that receives a wire and a terminal configured to be crimped to the wire by the crimp tooling. A first ultrasonic transducer is held by the ram. The first ultrasonic transducer is ultrasonically coupled to the terminal and the wire and ultrasonically isolated from the ram. A second ultrasonic transducer is held by the anvil. The second ultrasonic transducer is ultrasonically coupled to the terminal and the wire and ultrasonically isolated from the anvil. Acoustic signals are transmitted between the first and second ultrasonic transducers through the terminal and the wire.

DETAILED DESCRIPTION OF THE INVENTION

Figure 1:
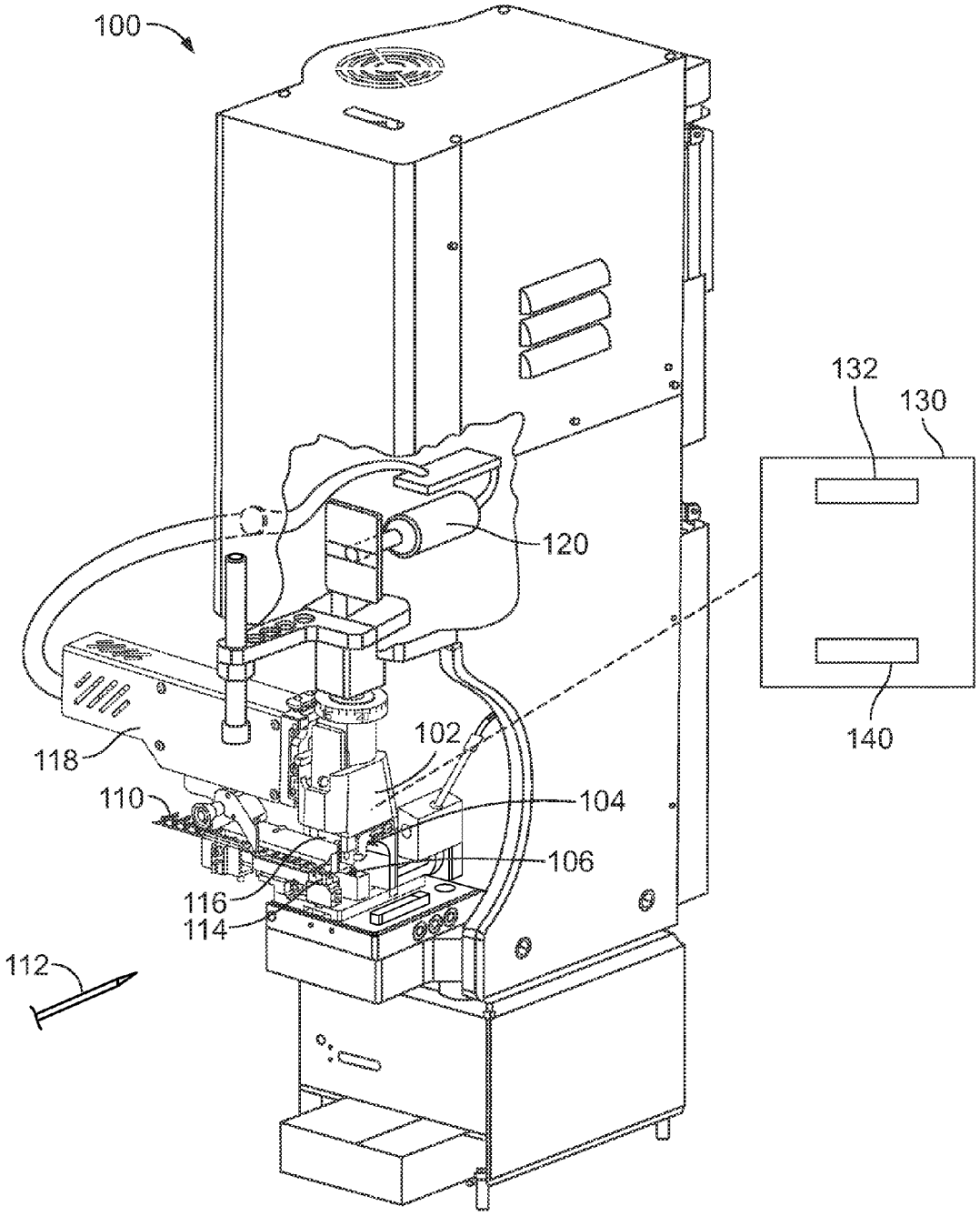
FIG. 1 is a perspective view of a terminal crimping device according to an exemplary embodiment.

FIG. 1 is a perspective view of a terminal crimping device 100 formed in accordance with an exemplary embodiment. The terminal crimping device 100 is used for crimping terminals to wires. In the illustrated embodiment, the terminal crimping device 100 is a bench machine having an applicator 102. Alternatively, the terminal crimping device 100 may be another type of crimping machine, such as a lead maker or a hand tool.

The terminal crimping device 100 includes crimp tooling 104 that is used to form the terminal during the pressing or crimping operation. The terminal crimping device 100 has a terminating zone or crimp zone 106 defined between the crimp tooling 104. Electrical connectors or terminals 110 and an end of a wire 112 are presented in the crimp zone 106 between the crimp tooling 104. In an exemplary embodiment, the crimp tooling 104 used for crimping includes an anvil 114 and a ram 116. The anvil 114 and/or the ram 116 may have removable dies that define the shape or profile of the terminal 110 during the crimping process. In the illustrated embodiment, the anvil 114 is a stationary component of the applicator 102, and the ram 116 represents a movable component. Alternatively, both the ram 116 and the anvil 114 may be movable. For example, with hand tools, typically both halves of the crimp tooling 104 are closed toward each other during the crimping operation.

The terminal crimping device 100 includes a feeder device 118 that is positioned to feed the terminals 110 to the crimp zone 106. The feeder device 118 may be positioned adjacent to the mechanical crimp tooling 104 in order to deliver the terminals 110 to the crimp zone 106. The terminals 110 may be guided to the crimp zone 106 by a feed mechanism to ensure proper placement and/orientation of the terminal 110 in the crimp zone 106. The wire 112 is delivered to the crimp zone 106 by a wire feeder (not shown).

During a crimping operation, the ram 116 of the applicator 102 is driven through a crimp stroke by a driving mechanism 120 of the terminal crimping device 100 initially towards the stationary anvil 114 and finally away from the anvil 114. Thus, the crimp stroke has both a downward component and an upward component. The crimping of the terminal 110 to the wire 112 occurs during the downward component of the crimp stroke. During the crimping operation, a terminal 110 is loaded onto the anvil 114 in the crimp zone 106, and an end of the wire 112 is fed within a crimp barrel of the terminal 110. The ram 116 is then driven downward along the crimp stroke towards the anvil 114. The ram 116 engages the crimp barrel of the terminal 110 and deforms (e.g. folds or rolls) the ends of the crimp barrel inward around the wire 112. The crimp tooling 104 crimps the terminal 110 onto the wire 112 by compressing or pinching the terminal 110 between the ram 116 and the anvil 114. The ram 116 then returns to an upward position. As the ram 116 moves upward, the ram 116 releases or separates from the terminal 110. In an exemplary embodiment, the resilient nature of the terminal 110 and/or wires 112 causes the terminal 110 to rebound slightly from the bottom dead center of the downward portion of the crimp stroke. The elastic yield or spring back of the terminal 110 will follow the ram 116 for a portion of the return or upward part of the stroke of the ram 116 until the terminal 110 reaches a final or stable size. At such point, the terminal 110 has a particular crimp height measured between the bottom and top most points of the terminal 110.

The operation of the terminal crimping device 100 is controlled by a control module 130. For example, the control module 130 may control the operation of the driving mechanism 120. The control module 130 may control the operation of the feeder device 118 and synchronizes the timing of the crimp stroke with the timing of a feed stroke of the feeder device 118. In an exemplary embodiment, the control module 130 includes a crimp quality module 132 that determines a crimp quality of the particular crimp. The terminal 110 may be discarded if the crimp quality does not meet certain specifications. In an exemplary embodiment, the crimp quality module 132 determines a crimp height of the terminal as a measure of crimp quality. The crimp quality module 132 may determine crimp quality based on other characteristics in addition to, or in the alternative to, the crimp height, such as a force measurement or force profile of the terminal during the crimp.

In an exemplary embodiment, the control module 130 includes an ultrasound module 140 for transmitting and receiving ultrasonic acoustic signals. The ultrasound module 140 may cause acoustic signals to be transmitted through the terminal 110 and the wire 112 during the crimping operation. The crimp quality module 132 may determine crimp quality based on the acoustic signals transmitted through the terminal 110 and the wire 112. The crimp quality module 132 may determine a crimp height of the terminal 110 based on the acoustic signals transmitted through the terminal 110 and the wire 112. The crimp quality module 132 may determine a shape of the crimped terminal based on the acoustic signals transmitted through the terminal 110 and the wire 112. In an exemplary embodiment, ultrasonic transducers of the ultrasound module 140 directly engage the crimped terminal to send acoustic signals directly through the crimped terminal without first passing through the crimp tooling 104. Eliminating transmission through the crimp tooling 104 eliminates one or more acoustic boundaries, enhancing the received acoustic signals that are used for analysis for crimp quality. Transmission of the acoustic signals through the crimp tooling in addition to the crimped terminal degrades the acoustic signals and creates noise or echoes. The shape of the crimp tooling at the interface with the crimped terminal may be complex, leading to a poor acoustic boundary. Avoiding such acoustic boundary will enhance the quality of the signal received and analyzed. For example, reflections of the acoustic signals may be reduced or minimized, reducing noise received at the receiving transducer.

Figure 2:
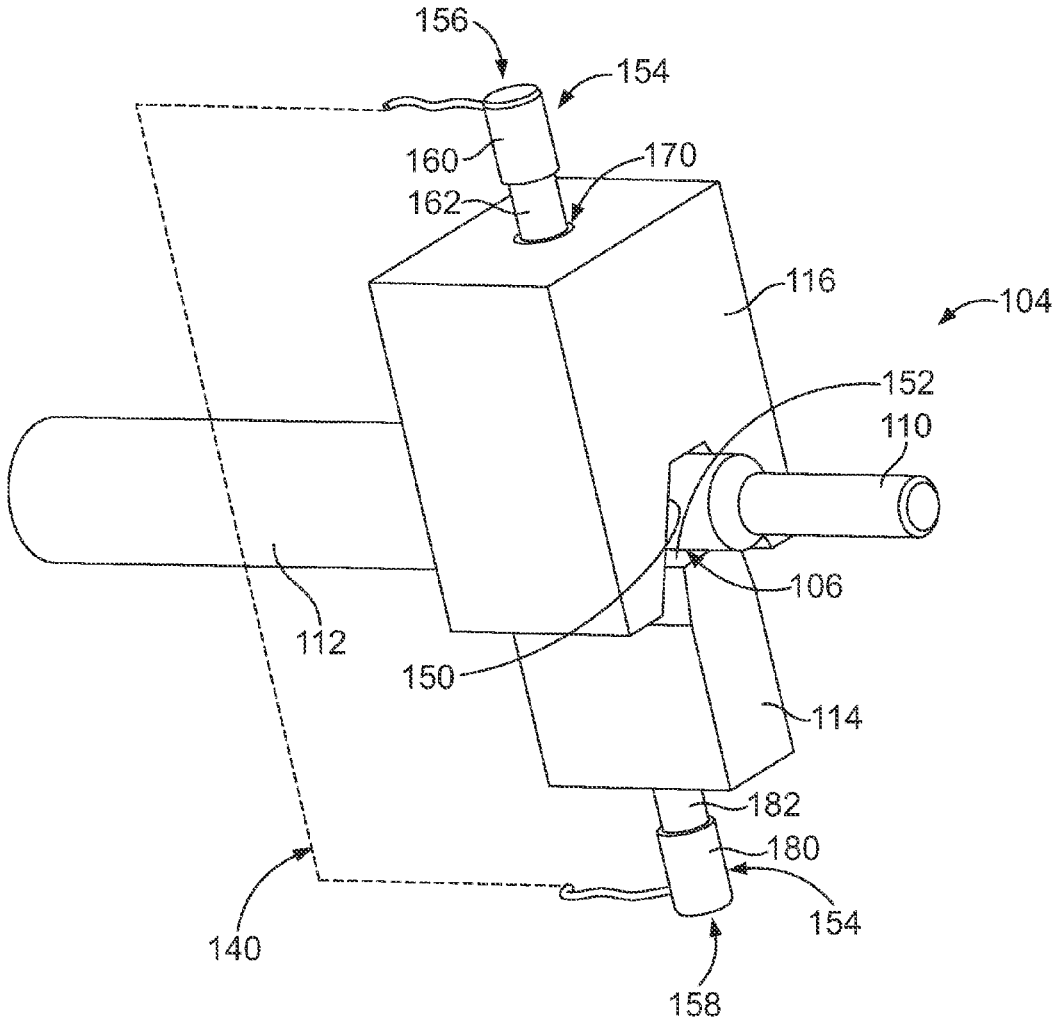
FIG. 2 illustrates a portion of the terminal crimping device showing an anvil and a ram used to form a crimped terminal during a crimping operation.
Figure 3:
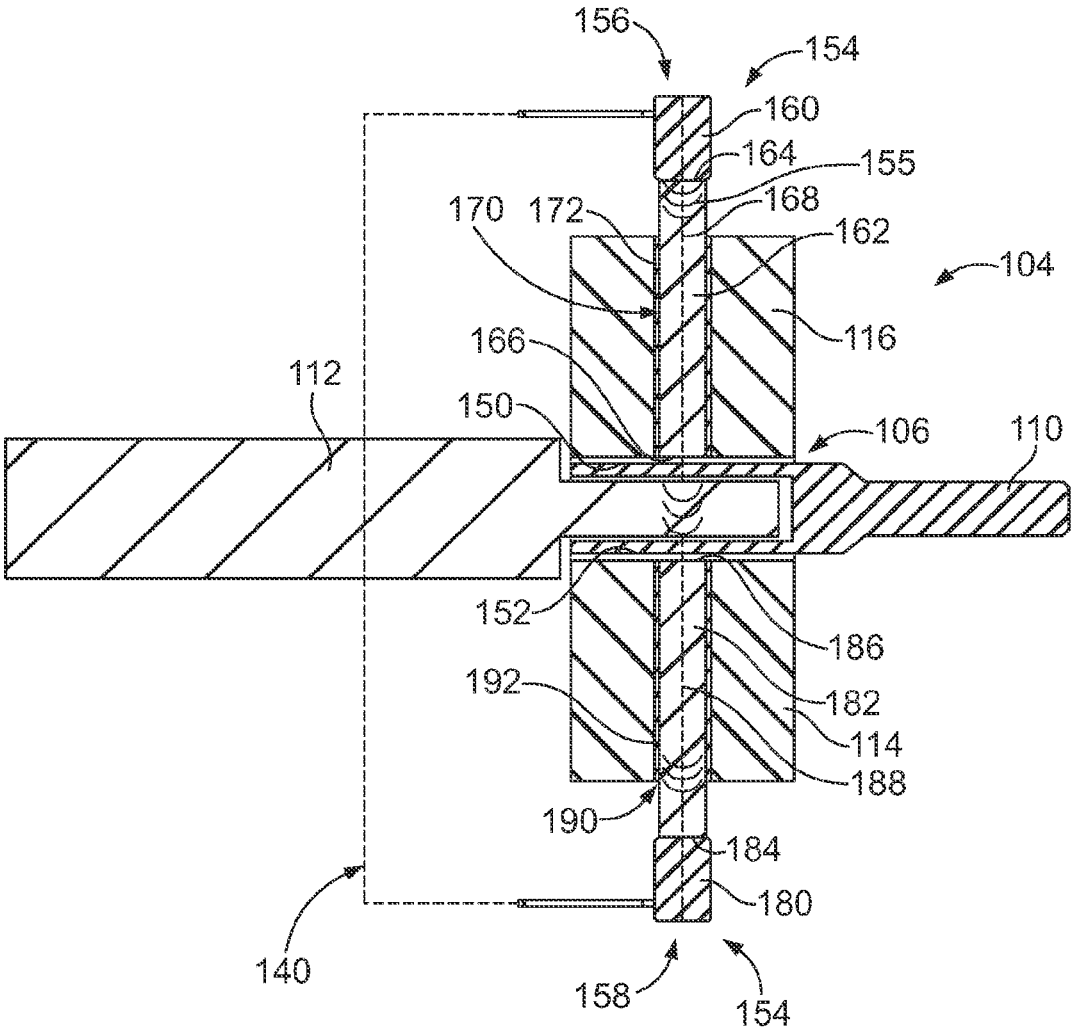
FIG. 3 is a cross sectional view of the crimp tooling with a terminal and wire positioned between the anvil and the ram.

FIG. 2 illustrates a portion of the terminal crimping device 100 showing the anvil 114 and the ram 116 used to form the crimp during the crimping operation. FIG. 3 is a cross sectional view of the crimp tooling 104 with the terminal 110 and wire 112 positioned between the anvil 114 and the ram 116. The crimp tooling 104 may be used to form an open barrel crimp, such as an F-crimp; however other shape crimp tooling may form crimps having other shapes in alternative embodiments.

The ram 116 has a crimping surface 150 that engages the terminal 110 during the crimping process. The crimping surface 150 presses the corresponding terminal structure, such as sidewalls of the terminal barrel, inward during the crimping process. The crimping surface 150 compresses the terminal structure against the wire 112 during the crimping process.

The anvil 114 has a crimping surface 152 used to support the terminal 110. In the illustrated embodiment, the crimping surface 152 is flat and horizontal; however the crimping surface 152 may have other shapes and/orientations in alternative embodiments. The terminal 110 rests on the crimping surface 152 as the ram 116 is moved through the crimp stroke.

In an exemplary embodiment, the ultrasound module 140 (shown in FIG. 1) includes one or more ultrasonic transducers 154 that transmit and/or receive acoustic signals 155 in the ultrasonic frequency range. The ultrasonic transducers 154 may be part of assemblies and may be referred to hereinafter as ultrasonic transducer assemblies 154. In the illustrated embodiment, the ultrasound module 140 includes one ultrasonic transmitting transducer assembly 156 and one ultrasonic receiving transducer assembly 158; however any number of transmitting or receiving assemblies may be provided in alternative embodiments. In other embodiments, rather than having dedicated transmitting and receiving transducer assemblies, either or both of the transducer assemblies 156, 158 may be capable of transmitting and receiving the acoustic signals. In other embodiments, only one transducer assembly 156, 158 is needed that is capable of transmitting and receiving the acoustic signals 155.

The ultrasonic transmitting transducer assembly 156 is coupled to and held by the ram 116. The transmitting transducer assembly 156 includes a transmitting transducer 160 and a transmitting probe 162. The transmitting transducer 160 generates and transmits the acoustic signals 155 therefrom. The transmitting probe 162 extends from the transmitting transducer 160 and is ultrasonically coupled to the transmitting transducer 160 to receive the acoustic signals 155 therefrom.

In an exemplary embodiment, the transmitting probe 162 is cylindrical in shape and extends between a first end 164 and a second end 166 along a linear axis 168. The transmitting probe 162 may have other shapes in alternative embodiments. In an exemplary embodiment, the first end 164 directly engages and is ultrasonically coupled to the transmitting transducer 160, with an optional acoustic transmission material, such as an acoustic gel, therebetween. In an exemplary embodiment, the second end 166 directly engages and is ultrasonically coupled to the terminal 110, with an optional acoustic transmission material, such as an acoustic gel, therebetween. The acoustic signals 155 are transmitted directly from the transmitting transducer 160 to the terminal 110 and wire 112.

The transmitting probe 162 is received in a recess 170 formed in the ram 116. In an exemplary embodiment, the recess 170 is open at the crimping surface 150 to expose the transmitting probe 162 to the terminal 110. The transmitting probe 162 is ultrasonically coupled to the terminal 110. In an exemplary embodiment, the transmitting probe 162 directly engages the terminal 110 to transmit the acoustic signals 155 from the transmitting transducer 160 to the terminal 110. Optionally, a portion of the terminal 110 may extend into the recess 170 to directly engage the probe 162.

In an exemplary embodiment, an isolation member 172 is provided that ultrasonically isolates (e.g. limit or restrict) the transmitting transducer assembly 156 from the ram 116. The isolation member 172 may be provided in the recess 170 between the transmitting probe 162 and the ram 116. The isolation member 172 may be a lining along the surface of the recess 170, or alternatively, may be selectively positioned within the recess 170 between the transmitting probe 162 and the ram 116. The isolation member 172 may be a sleeve received in the recess 170 prior to loading the transmitting probe 162 therein. The isolation member 172 may be a sleeve coupled to and surrounding the transmitting probe 162 prior to loading the transmitting probe 162 into the recess 170.

The isolation member 172 operates as a barrier for the acoustic signals 155 to limit or restrict the transmission of the acoustic signals 155 into the ram 116 and/or from the ram 116 into the transmitting probe 162. The isolation member 172 physically separates the transmitting probe 162 from the ram 116 to limit or restrict the transmission of the acoustic signals 155 into the ram 116. Optionally, the isolation member 172 may limit the acoustic signals 155 by restricting at least half of the acoustic signals 155 from transmitting into the ram 116. Optionally, the isolation member 172 may limit the acoustic signals 155 by restricting at least 90% of the acoustic signals 155 from transmitting into the ram 116. The isolation member 172 may limit the acoustic signals 155 by restricting substantially all (e.g. 99% or more) of the acoustic signals 155 from transmitting into the ram 116. Optionally, the isolation member 172 may limit the acoustic signals 155 by restricting at least some of the acoustic signals 155 from transmitting into the ram 116.

The isolation member 172 may be manufactured from a material having a low characteristic acoustic impedance, such as below 10 Rayl. Optionally, the isolation member 172 may be manufactured from a material having a low characteristic acoustic impedance, such as below 1 Rayl. The isolation member 172 may be manufactured from a rubber material, an acrylic resin material, a nylon material, a polystyrene material, a polyvinylchloride material or another material having a low characteristic acoustic impedance. The isolation member 172 may be manufactured from a foam material or a felt material. The isolation member 172 may be manufactured from a perforated sheet. The isolation member 172 may be a layered structure, and may be manufactured from multiple layers. The isolation member 172 may be manufactured from an absorptive material, such as Beryllium, Tungsten, or other suitable ultrasonic absorbing material. The isolation member 172 may be defined by an air gap that is substantially or entirely devoid of material between the transmitting probe 162 and the ram 116. The isolation member 172 may have a series of voids or openings that are filled with air to isolate the transmitting probe 162 from the ram 116.

Optionally, the transmitting transducer 160 may be held external of the ram 116, while the transmitting probe 162 extends through the ram 116 to engage the terminal 110. In other embodiments, the transmitting transducer 160 may be held interior of the ram 116, such as within a pocket or chamber inside the ram 116. In other embodiments, the transmitting transducer assembly 156 may be coupled to and held by the anvil 114 rather than the ram 116.

The ultrasonic receiving transducer assembly 158 is coupled to and held by the anvil 114. The receiving transducer assembly 158 includes a receiving transducer 180 and a receiving probe 182. The receiving transducer 180 receives the acoustic signals 155 and converts the acoustic signals into electrical signals for analysis by the control module 130 (shown in FIG. 1). The receiving probe 182 extends from the receiving transducer 180 and is ultrasonically coupled to the receiving transducer 180 and terminal 110. The acoustic signals 155 pass through the terminal 110 and wire 112 to the receiving probe 182, which passes the acoustic signals 155 to the receiving transducer 180.

In an exemplary embodiment, the receiving probe 182 is cylindrical in shape and extends between a first end 184 and a second end 186 along a linear axis 188. The receiving probe 182 may be identical to the transmitting probe 162. The receiving probe 182 may be axially aligned with the transmitting probe 162 on the opposite side of the terminal 110. Alternatively, the receiving probe 182 may be at any location along the terminal 110 to receive the acoustic signals 155 from the terminal 110 and wire 112. The receiving probe 182 may have other shapes in alternative embodiments. The first end 184 directly engages and is ultrasonically coupled to the receiving transducer 180, with an optional acoustic barrier, such as an acoustic gel, therebetween. The second end 186 directly engages and is ultrasonically coupled to the terminal 110, with an optional acoustic barrier, such as an acoustic gel, therebetween. The acoustic signals 155 are transmitted directly from the terminal 110 and wire 112 to the receiving transducer 180.

The receiving probe 182 is received in a recess 190 formed in the anvil 114. In an exemplary embodiment, the recess 190 is open at the crimping surface 152 to expose the receiving probe 182 to the terminal 110. The receiving probe 182 is configured to directly engage the terminal 110 to transmit the acoustic signals 155 from the terminal 110 to the receiving transducer 180.

In an exemplary embodiment, an isolation member 192 is provided that ultrasonically isolates (e.g. limit or restrict) the receiving transducer assembly 158 from the anvil 114. The isolation member 192 may be identical to the isolation member 172. The isolation member 192 may be provided in the recess 190 between the receiving probe 182 and the anvil 114. The isolation member 192 may be a lining along the surface of the recess 190, or alternatively, may be selectively positioned within the recess 190 between the receiving probe 182 and the anvil 114. The isolation member 192 may be a sleeve received in the recess 190 prior to loading the receiving probe 182 therein. The isolation member 192 may be a sleeve coupled to and surrounding the receiving probe 182 prior to loading the receiving probe 182 into the recess 190.

The isolation member 192 operates as a barrier for the acoustic signals 155 to limit or restrict the transmission of the acoustic signals 155 into the anvil 114 and/or from the anvil 114 into the receiving probe 182. The isolation member 192 physically separates the receiving probe 182 from the anvil 114 to limit or restrict the transmission of the acoustic signals 155 from the anvil 114 into the receiving probe 182. Optionally, the isolation member 192 may limit the acoustic signals 155 by restricting at least half of the acoustic signals 155 from transmitting from the anvil 114 into the receiving probe 182. Optionally, the isolation member 192 may limit the acoustic signals 155 by restricting at least 90% of the acoustic signals 155 from transmitting from the anvil 114 into the receiving probe 182. The isolation member 192 may limit the acoustic signals 155 by restricting substantially all (e.g. 99% or more) of the acoustic signals 155 from transmitting from the anvil 114 into the receiving probe 182. Optionally, the isolation member 192 may limit the acoustic signals 155 by restricting at least some of the acoustic signals 155 from transmitting from the anvil 114 into the receiving probe 182.

The isolation member 192 may be manufactured from a material having a low characteristic acoustic impedance, such as below 10 Rayl. Optionally, the isolation member 192 may be manufactured from a material having a low characteristic acoustic impedance, such as below 1 Rayl. The isolation member 192 may be manufactured from a rubber material, an acrylic resin material, a nylon material, a polystyrene material, a polyvinylchloride material or another material having a low characteristic acoustic impedance. The isolation member 192 may be manufactured from a foam material or a felt material. The isolation member 192 may be manufactured from a perforated sheet. The isolation member 192 may be a layered structure, and may be manufactured from multiple layers. The isolation member 192 may be manufactured from an absorptive material, such as Beryllium, Tungsten, or other suitable ultrasonic absorbing material. The isolation member 192 may be defined by an air gap that is substantially or entirely devoid of material between the receiving probe 182 and the anvil 114. The isolation member 192 may have a series of voids or openings that are filled with air to isolate the receiving probe 182 from the anvil 114.

Optionally, the receiving transducer 180 may be held external of the anvil 114, while the receiving probe 182 extends through the anvil 114 to engage the terminal 110. In other embodiments, the receiving transducer 180 may be held interior of the anvil 114, such as within a pocket or chamber inside the anvil 114. In other embodiments, the receiving transducer assembly 158 may be coupled to and held by the ram 116 rather than the anvil 114.

In an exemplary embodiment, the ultrasonic transducers 160, 180 are piezoelectric transducers that convert electrical energy into sound or convert sound waves into electrical energy. The piezoelectric transducers change size when a voltage is applied thereto. The ultrasound module 140 includes electric circuitry coupled to the transmitting transducer 160 to supply an alternating current across the transmitting transducer 160 to cause oscillation at very high frequencies to produce very high frequency sound waves. The ultrasonic receiving transducer 180 generates a voltage when force is applied thereto from the acoustic signals 155 and the electric signal generated at the ultrasonic receiving transducer 180 is transmitted by electric circuitry coupled thereto to the ultrasound module 140, the crimp quality module 132 (shown in FIG. 1) and/or the control module 130. Other types of ultrasonic transducers 160, 180 other than piezoelectric transducers may be used in alternative embodiments, such as magnetostrictive transducers.

In an exemplary embodiment, the ultrasound module 140 is used to determine crimp quality characteristics of the crimped terminal, such as the crimp height of the formed wire 112 and terminal 110, by generating the ultrasonic acoustic signals 155 at the transmitting transducer 160. The acoustic signal 155 travels through the transmitting probe 162 and crimped terminal 110 and wire 112 in the form of a longitudinal sound wave, however the wave may be propagated in any direction. The ultrasonic receiving transducer assembly 158 receives the acoustic signal 155 and converts such signal to an electrical signal for processing, such as by the crimp quality module 132. For example, the acoustic signal 155 is transmitted from the terminal 110 to the receiving probe 182 and through the receiving probe 182 to the receiving transducer 180. Such process may be repeated approximately 500 or more times per crimp cycle.

In an exemplary embodiment, the acoustic signals 155 received at the receiving transducer 180 are unaffected or minimally affected by acoustic signals passing through the metal material of the crimp tooling 104. For example, the isolation members 172, 192 operate to ultrasonically isolate the transmitting transducer assembly 156 and receiving transducer assembly 158 from the metal material of the crimp tooling 104. The isolation members 172, 192 are used to filter the acoustic signals 155 and affect the acoustic signals 155 in some manner to improve the signal received by the ultrasonic receiving transducer 180. The isolation members 172, 192 may increase the signal-to-noise ratio of the received acoustic signals at the receiving transducer 180 as compared to systems that pass the acoustic signals 155 through the ram 116 and anvil 114 along the path between the transmitting and receiving transducers 160, 180. The isolation members 172, 192 reduce the amount of reflected energy, such as echoed signals, that reach the crimp zone 106. The isolation members 172, 192 reduce the reflected energy, such as echoed signals, that reaches the receiving transducer 180. Reducing the reflections increases the overall percentage of the received signal attributable to the initial transmitted wave passing through the crimped terminal. A better signal may be received and analyzed by the receiving transducer 180 and crimp quality module 132. The signal-to-noise ratio of the received acoustic signals at the receiving transducer 180 may be increased with the use of the isolation members 172, 192.

Figure 4:
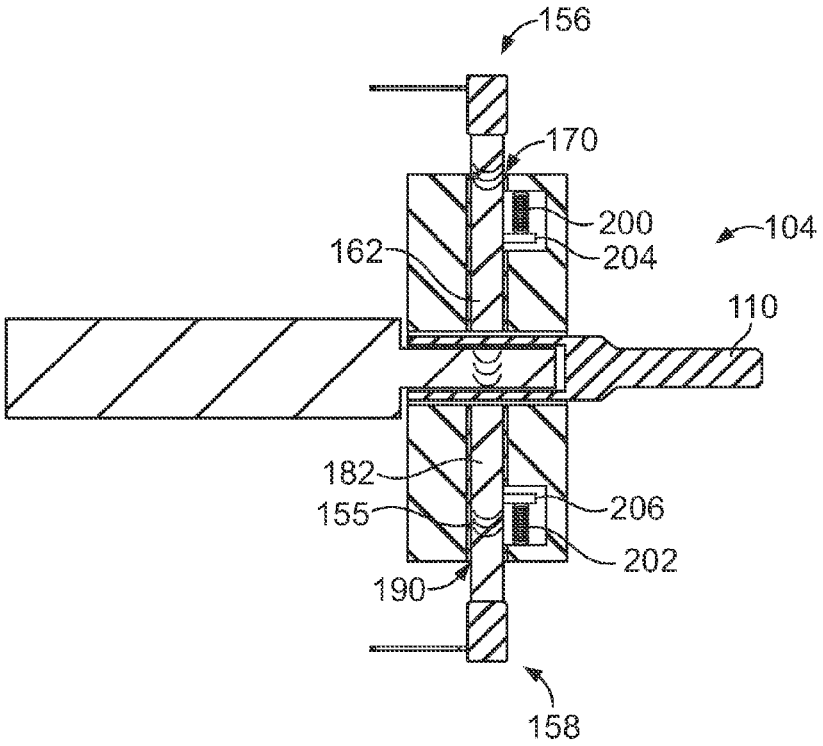
FIG. 4 is a cross sectional view of the crimp tooling and an ultrasound module formed in accordance with an exemplary embodiment.

FIG. 4 is a cross sectional view of the crimp tooling 104 and ultrasound module 140 formed in accordance with an exemplary embodiment. FIG. 4 illustrates compression members 200, 202 operatively coupled to the ultrasonic transducer assemblies 156, 158. The compression members 200, 202 force the ultrasonic transducer assemblies 156, 158 into engagement with the terminal 110. The compression members 200, 202 spring bias the probes 162, 182 against the terminal 110 to ensure direct physical contact between the ultrasonic transducer assemblies 156, 158 and the terminal 110 sufficient to allow the ultrasonic acoustic signals 155 to pass through the interfaces between the ultrasonic transducer assemblies 156, 158 and the terminal 110.

In the illustrated embodiment, the compression members 200, 202 are coil springs; however other types of compression members 200, 202 may be used in alternative embodiments, such as other types of springs, elastic foam pieces, and the like. The compression members 200, 202 engage posts 204, 206, respectively, extending from the probes 162, 182 to press the probes 162, 182 toward the terminal 110. The compression members 200, 202 may engage other portions of the probes 162, 182 in alternative embodiments.

Optionally, while the compression members 200, 202 provide sufficient force to hold the probes 162, 182 against the terminal 110, the compression members 200, 202 may allow the probes 162, 182 to float within the recesses 170, 190 during engagement with the terminal 110 so that the probes are not used to compress the terminal 110 during the crimping process. The probes 162, 182 may be protected from damage by ensuring that the probes 162, 182 are not used to compress the hard metal material of the terminal 110.

Figure 5:
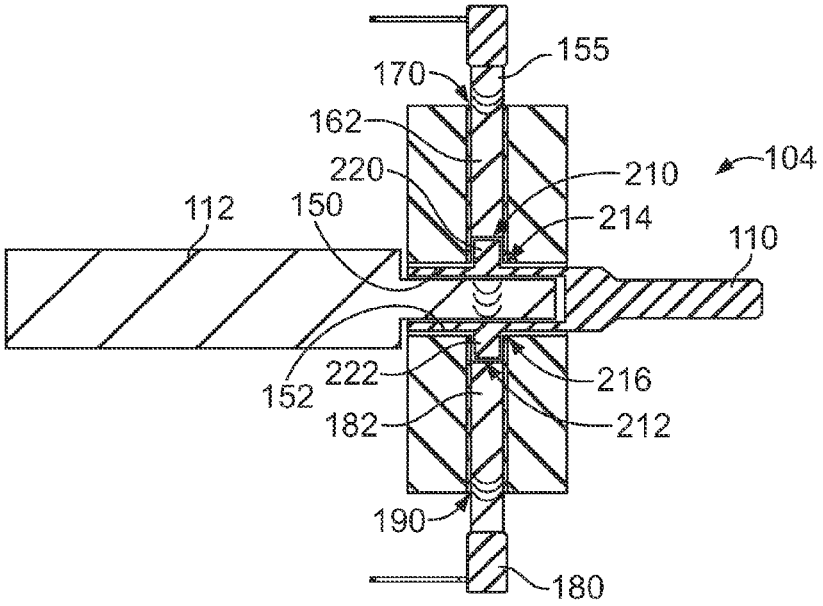
FIG. 5 is a cross sectional view of the crimp tooling and ultrasound module formed in accordance with an exemplary embodiment.

FIG. 5 is a cross sectional view of the crimp tooling 104 and ultrasound module 140 formed in accordance with an exemplary embodiment. FIG. 5 illustrates the probes 162, 182 sunken within the recesses 170, 190, respectively. The probes 162, 182 are recessed behind the crimping surfaces 152, 150 such that pockets 210, 212 are formed behind openings 214, 216 to the recesses 170, 190 at the crimping surfaces 152, 150. Having the probes 162, 182 sunken in the recesses 170, 190 prevents damage to the probes 162, 182.

During crimping, as the terminal 110 approaches maximum compression, the material of the terminal 110 is squeezed into the pockets 210, 212 forming protrusions 220, 222. The protrusions 220, 222 contact the faces of the probes 162, 182 allowing the ultrasonic acoustic signals 155 to be transmitted across the interface from the transmitting probe 162 to the terminal 110 and wire 112 and also across the interface from the terminal 110 and wire 112 to the receiving probe 182. Prior to the protrusions 220, 222 contacting the faces of the probes 162, 182, air gaps exist between the faces of the probes 162, 182 and the terminal 110. The acoustic signals 155 are not effectively transmitted across the air gaps, and thus no signal monitoring will occur. After the protrusions 220, 222 contact the faces of the probes 162, 182, the acoustic signals 155 may be effectively transmitted and received, and thus the signal monitoring is able to occur.

Optionally, the control module 130 (shown in FIG. 1) may sense when the protrusions 220, 222 contact the faces of the probes 162, 182, such as by monitoring the ultrasound module 140 and the signals received (or lack of signals being received) at the receiving transducer 180. Once the control module 130 senses that the protrusions 220, 222 are contacting the faces of the probes 162, 182, the control module 130 may initiate operation of the crimp quality module 132 to start analyzing the received signals.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A terminal crimping device comprising:

crimp tooling comprising an anvil and a ram, a crimp zone being defined between the anvil and the ram configured to receive a wire and a terminal configured to be crimped to the wire by the crimp tooling; and an ultrasonic transducer assembly held by at least one of the anvil and the ram and being ultrasonically isolated from the corresponding crimp tooling such that acoustic signals do not pass directly between the ultrasonic transducer assembly and the corresponding crimp tooling, the ultrasonic transducer assembly being configured to be ultrasonically coupled to the terminal and being ultrasonically isolated from the crimp tooling.

2. The terminal crimping device of claim 1, wherein the ultrasonic transducer assembly is configured to directly engage the terminal.

3. The terminal crimping device of claim 1, wherein the crimp tooling includes a recess, the recess being lined with an isolation member, the ultrasonic transducer assembly being received in the recess for engaging the terminal, the isolation member being positioned between the ultrasonic transducer assembly and the crimp tooling to ultrasonically isolate the ultrasonic transducer assembly from the crimp tooling.

4. The terminal crimping device of claim 1, wherein the crimp tooling includes a crimping surface configured to engage the terminal during the crimping process, the crimp tooling having a recess open at the crimping surface, the ultrasonic transducer assembly being received in the recess for engaging the terminal.

5. The terminal crimping device of claim 1, wherein the ultrasonic transducer assembly includes a transmitting transducer configured to transmit acoustic signals and a transmitting probe extending from the transmitting transducer, the transmitting probe configured to directly engage the terminal to transmit the acoustic signals from the transmitting probe to the terminal.

6. The terminal crimping device of claim 1, wherein the ultrasonic transducer assembly includes a transmitting transducer configured to transmit acoustic signals and a transmitting probe extending between a first end and a second end, the first end directly engaging and being ultrasonically coupled to the transmitting transducer, the second end configured to directly engage and be ultrasonically coupled to the terminal.

7. The terminal crimping device of claim 1, further comprising an isolation member ultrasonically isolating the ultrasonic transducer assembly from the crimp tooling.

8. The terminal crimping device of claim 1, wherein the ultrasonic transducer assembly is configured to be spring biased against the terminal to ensure direct physical contact between the ultrasonic transducer assembly and the terminal sufficient to allow ultrasonic acoustic signals to pass through the interface between the ultrasonic transducer assembly and the terminal.

9. The terminal crimping device of claim 1, further comprising a compression member operatively coupled to the ultrasonic transducer assembly and configured to force the ultrasonic transducer assembly into engagement with the terminal.

10. The terminal crimping device of claim 1, wherein the crimp tooling includes a recess having an opening configured to be positioned at the terminal, the ultrasonic transducer assembly received in the recess, wherein the recess is configured to receive a protrusion of the terminal formed during the crimping process, the ultrasonic transducer assembly engaging the protrusion within the recess.

11. The terminal crimping device of claim 10, further comprising a control module operatively coupled to the ultrasonic transducer assembly, the control module causing the ultrasonic transducer assembly to transmit ultrasonic acoustic signals only after the protrusion contacts the ultrasonic transducer assembly.

12. The terminal crimping device of claim 1, further comprising an isolation member surrounding at least a portion of the ultrasonic transducer assembly to physically separate the ultrasonic transducer assembly from the crimp tooling.

13. The terminal crimping device of claim 1, further comprising a plurality of ultrasonic transducer assemblies held by the crimp tooling.

14. The terminal crimping device of claim 1, wherein the ultrasonic transducer assembly includes a first ultrasonic transducer held by the ram and being ultrasonically isolated from the ram such that acoustic signals do not pass directly between the first ultrasonic transducer and the ram and a second ultrasonic transducer held by the anvil and being ultrasonically isolated from the anvil such that acoustic signals do not pass directly between the second ultrasonic transducer and the anvil, the first and second ultrasonic transducers being configured to be ultrasonically coupled to the terminal and the wire such that acoustic signals are configured to be transmitted between the first and second ultrasonic transducers through the terminal and the wire.

15. The terminal crimping device of claim 14, further comprising a first isolation member positioned between and ultrasonically isolating the first ultrasonic transducer and the ram and further comprising a second isolation member positioned between and ultrasonically isolating the second ultrasonic transducer and the anvil.

16. A terminal crimping device comprising:

crimp tooling defining a crimp zone configured to receive a wire and a terminal configured to be crimped to the wire by the crimp tooling;

an ultrasonic transducer assembly held by the crimp tooling in proximity to the crimp tooling, the ultrasonic transducer assembly being configured to be ultrasonically coupled to the terminal and the wire; and an isolation member between the ultrasonic transducer assembly and the crimp tooling, the isolation member ultrasonically isolating the ultrasonic transducer assembly from the crimp tooling.

17. The terminal crimping device of claim 16, wherein the ultrasonic transducer assembly is configured to directly engage the terminal.

18. The terminal crimping device of claim 16, wherein the crimp tooling includes a recess, the ultrasonic transducer assembly being received in the recess for engaging the terminal, the isolation member being positioned between the ultrasonic transducer assembly and the crimp tooling to ultrasonically isolate the ultrasonic transducer assembly from the crimp tooling.

19. The terminal crimping device of claim 16, wherein the ultrasonic transducer assembly includes a transmitting transducer configured to transmit acoustic signals and a transmitting probe extending from the transmitting transducer, the transmitting probe configured to directly engage the terminal to transmit the acoustic signals from the transmitting probe to the terminal.

20. The terminal crimping device of claim 19, wherein the isolation member surrounds the transmitting probe to ultrasonically isolate the transmitting probe from the crimp tooling.

* * * * *